US008674278B2

(12) United States Patent
Buckland et al.

(10) Patent No.: US 8,674,278 B2
(45) Date of Patent: Mar. 18, 2014

(54) CONTROL OF PROJECTILES OR THE LIKE

(75) Inventors: Roy William Buckland, Croydon (GB); Stephen George Gladwell Smith, Sevenoaks (GB)

(73) Assignee: Qinetiq Limited (GB)

( * ) Notice: Subject to any disclaimer, the term of this patent is extended or adjusted under 35 U.S.C. 154(b) by 310 days.

(21) Appl. No.: 12/867,868

(22) PCT Filed: Jan. 13, 2009

(86) PCT No.: PCT/GB2009/000082
§ 371 (c)(1),
(2), (4) Date: Aug. 16, 2010

(87) PCT Pub. No.: WO2009/103939
PCT Pub. Date: Aug. 27, 2009

(65) Prior Publication Data

US 2010/0314489 A1 Dec. 16, 2010

(30) Foreign Application Priority Data

Feb. 22, 2008 (GB) ..... 0803282.3

(51) Int. Cl.
*F42B 15/01* (2006.01)

(52) U.S. Cl.
USPC ..... 244/3.27; 244/3.21

(58) Field of Classification Search
USPC ..... 244/3.21, 3.27, 3.28, 3.3, 45 A
See application file for complete search history.

(56) References Cited

U.S. PATENT DOCUMENTS

| | | | |
|---|---|---|---|
| 4,076,187 | A | 2/1978 | Metz |
| 4,542,866 | A | 9/1985 | Caldwell et al. |
| 4,917,333 | A | 4/1990 | Murri |
| 5,271,579 | A | 12/1993 | DeLuca |
| 5,398,888 | A | 3/1995 | Gerhardt |

(Continued)

FOREIGN PATENT DOCUMENTS

| | | |
|---|---|---|
| CH | 323 227 | 7/1957 |
| GB | 778185 | 7/1957 |

(Continued)

OTHER PUBLICATIONS

Raytheon, Excalibur Datasheet, Precision-Guided, Long-Range, 15mm Artillery Projecticle, 2008.

*Primary Examiner* — Timothy D Collins
*Assistant Examiner* — Jamie S Stehle
(74) *Attorney, Agent, or Firm* — McDonnell Boehnen Hulbert & Berghoff LLP

(57) ABSTRACT

A gun-fired projectile or ballistic missile (1) is equipped with a pair of canards (3) and an array of tail fins (2). Selected tail fins can be retracted or jettisoned following the ballistic phase to vary the geometry of the array from a rotationally symmetrical configuration to an asymmetric configuration for the glide phase, which together with the canards tends to stabilize the projectile in roll. The canards (3) can be independently extended and retracted with respect to the body of the projectile to generate differential lift for banking the projectile to turn. The canards (3) also preferably have a positive dihedral angle with respect to the intended gliding attitude. In an alternative embodiment the canards are replaced by functionally equivalent thrusters.

12 Claims, 4 Drawing Sheets

(56) References Cited

U.S. PATENT DOCUMENTS

| | | | | |
|---|---|---|---|---|
| 5,439,188 | A | 8/1995 | Depew, Jr. et al. | |
| 5,590,850 | A | 1/1997 | Cannon et al. | |
| 6,869,044 | B2 | 3/2005 | Geswender et al. | |
| 7,185,846 | B1 * | 3/2007 | Bittle et al. | 244/3.28 |
| 2004/0232278 | A1 | 11/2004 | Geswender et al. | |
| 2005/0051666 | A1 | 3/2005 | Lee et al. | |
| 2007/0125904 | A1 | 6/2007 | Janka | |

FOREIGN PATENT DOCUMENTS

| | | |
|---|---|---|
| GB | 1283443 | 7/1972 |
| GB | 1523963 | 9/1978 |
| GB | 2085820 | 5/1982 |
| GB | 2244968 | 12/1991 |
| WO | WO 2005/073046 | 8/2005 |
| WO | WO 2007/058573 | 5/2007 |

* cited by examiner

CONTROL OF PROJECTILES OR THE LIKE

BACKGROUND OF THE INVENTION

Field of the Invention

The present invention relates to the directional control of projectiles or other bodies moving in a fluid medium, and its various aspects are exemplified by the projectile to be more particularly described hereinafter.

SUMMARY OF THE INVENTION

The invention is particularly concerned with projectiles such as unpowered munitions which are fired from a gun or other launcher, or guided missiles which may be powered by an onboard rocket motor or jet engine or the like thrust-producing device. In at least some aspects, however, the invention may be more generally applicable to the control of bodies moving through the air or water, such as cruise missiles guided bombs, manned or unmanned air vehicles, submarines or torpedoes.

In one aspect the invention resides in a body adapted to move in a fluid medium comprising a plurality of tail fins and at least a pair of incidence control means at a forward position of the body, and which is adapted to vary in geometry between (i) a first configuration in which said tail fins are in a generally rotationally symmetrical array around the longitudinal axis of the body and said incidence control means are in an inoperative or less operative condition and (ii) a second configuration in which said tail fins are in a rotationally asymmetric array around the longitudinal axis of the body and said incidence control means are in an operative or more operative condition.

The means for controlling the incidence of the body may comprise canards, and in a preferred embodiment there are a single pair of such devices each having positive dihedral with respect to an intended gliding attitude of the body, although other numbers of canards (e.g. four) may be provided in other embodiments of the invention. Alternative incidence control means having a similar effect to canards may be employed, however, and in particular may comprise thrusters.

In another aspect the invention resides in a method of operating such a body to follow a trajectory comprising a ballistic phase followed by a gliding phase wherein the body is in said first configuration during the ballistic phase and varies to said second configuration for the gliding phase.

In a further aspect the invention resides in a body adapted to move in a fluid medium comprising at least a pair of canards each of which is adapted to extend from and retract into the body so as to expose a variable surface area so that in use differential lift can be generated tending to bank the body in accordance with the respective exposed surface areas of said canards.

Each such canard may translate or pivot about a respective single axis to vary its respective exposed surface area. The respective axis is preferably at a forward position of the canard and its exposed surface area is preferably of generally delta platform in substantially any exposed condition. Each canard is also preferably of substantially constant cross-section along its span with respect to its path of movement.

In yet a further aspect the invention resides in a projectile or missile comprising a plurality of tail fins in a rotationally asymmetric array around the longitudinal axis of the body, and a single pair of canards, said canards having positive dihedral with respect to an intended gliding attitude of the projectile or missile. This aspect embraces examples where reconfiguration of the tail fin geometry need not take place and may include missiles which have little or no initial ballistic phase and small-scale direct-fire projectiles.

DESCRIPTION OF THE DRAWINGS

These and other aspects and features of the present invention will now be more particularly described by way of example as applied to a preferred embodiment in the form of a gun-fired projectile and with reference to the accompanying drawings in which.

DESCRIPTION OF THE INVENTION

Figure 1:
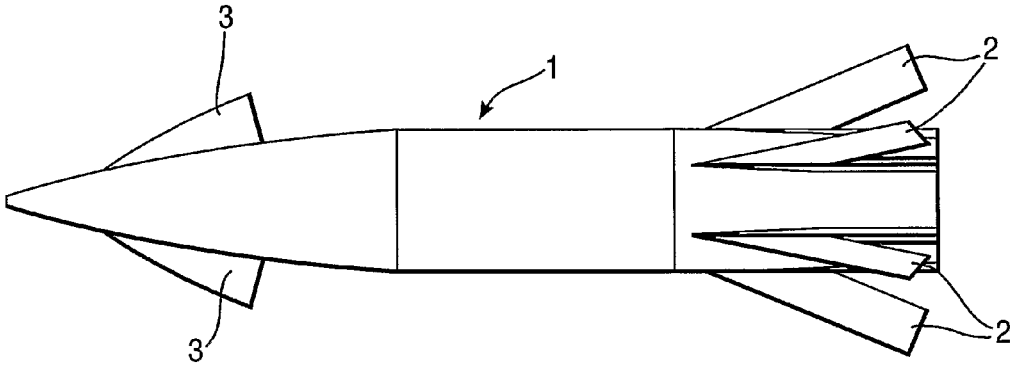
FIG. 1 is a plan view of the projectile as configured for its gliding phase.

With reference to FIG. 1 there is shown one embodiment of a gun-fired projectile 1 according to the invention which is equipped with an array of "pen-knife" tail fins 2 and a single pair of canards 3. The latter can be extended and retracted differentially by a mechanism to be described hereinafter. A guided missile could be configured similarly.

The illustrated projectile is a member of a known class of projectiles which utilise gliding airframes to achieve ranges far beyond the capabilities of conventional shells. Such projectiles are stabilised aerodynamically by the use of tail fins of various types. One known device has six fins of the pen-knife type, which are hinged at the front and deploy into their flight positions shortly after muzzle exit. Four canards are provided for guidance during the glide phase. This known device, however, employs a continuously slowly rolling airframe in both the ballistic (upleg) and glide phases, which has implications for the complexity, cost and power requirements of the control and actuation system because continuous adjustments then need to be made to the canard incidence angles. The projectile according to the illustrated embodiment of the present invention, on the other hand, employs an airframe which is essentially non-rotating (unspun) at least in the glide phase and preferably also in the ballistic phase, i.e. can achieve attitude control without rotation of its body or any part of it, and whose canards 3 (when deployed) do not need to oscillate continuously. It is also adapted for use in a method according to the invention whereby roll control can be achieved using a modification to the tail fin configuration during the glide phase. The projectile is shown in this condition in FIGS. 1 and 2.

Figure 2:
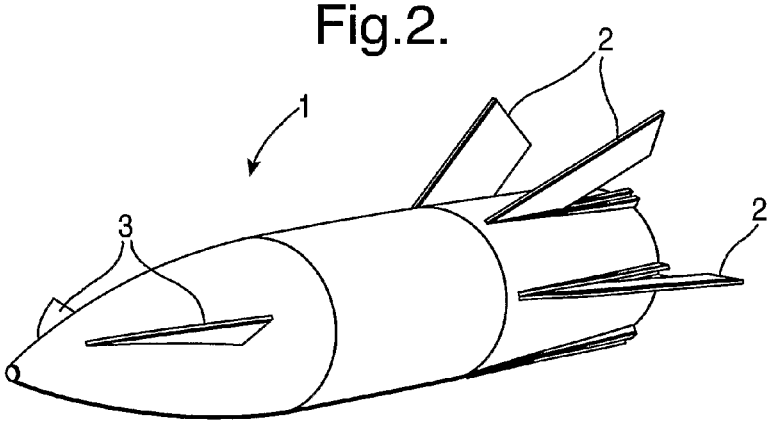
FIG. 2 is a three quarters view from one side of the projectile as configured for its gliding phase.
Figure 3:
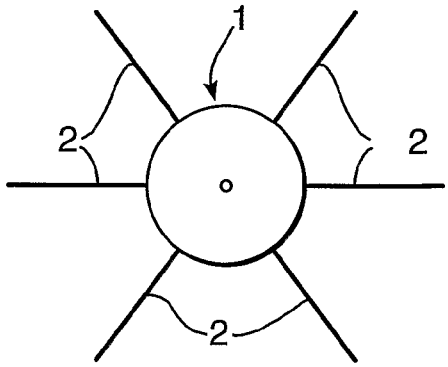
FIG. 3 is a schematic front view of the projectile as configured for its ballistic phase.

More particularly, and as shown in FIG. 3, a total array of six equi-spaced tail fins 2 are deployed in the known way at launch of the projectile 1 and remain in their rotationally symmetrical configuration around the longitudinal axis of the projectile for the duration of the ballistic flight phase, the canards 3 remaining fully retracted throughout this phase. Shortly after apogee, however, when the glide phase commences, the two tail fins 2 which are below the centreline of the projectile (with respect to the intended gliding attitude) are jettisoned or folded back into their stowage position within the body of the projectile. This leaves the rotationally asymmetric tail fin configuration indicated in FIGS. 2, 4 and 5 (although still symmetrical about a vertical plane through the centreline) and with the two central tail fins at a high positive dihedral angle (with respect to the intended gliding attitude). At this stage the canards 3 are also deployed (whether simultaneously or consecutively with the change of tail fin geometry). They also have a positive dihedral angle, and are arranged to generate lift in the direction of the arrows in FIG. 4 which (in the illustrated orientation of the projectile) can be resolved into respective components acting in both the vertical and laterally inward directions.

The combination of lift on the canards 3 and asymmetric drag on the tail fin array 2 will tend to cause the projectile to adopt an attitude with a small positive angle of incidence (typically 6 to 12 degrees) to the airstream. The asymmetric fin configuration will now have a component of airflow velocity passing across the blades from the "missing" fin side to the side with its fins still deployed, and the centre of lift of the fin array (CL in FIG. 5) will be off-axis, tending towards the deployed fins (lift being represented by the upward arrow in the Figure). The centre of mass (CM in FIG. 5) will be substantially at the centreline of the projectile, however, and the combination of these factors, together with any transient upward incidence created by the downward acceleration due to gravity (represented by the downward arrow in the Figure), should create a "righting" moment in response to roll displacements from the intended gliding attitude, causing the projectile to glide level and "nose up" with respect to the airstream. The projectile is thus stabilised in roll.

From this condition the canards 3 can be controlled differentially to bank the projectile to turn, for example to execute a precision impact, in response to an onboard navigation system or remote control input. This form of directional control can be distinguished from known rolling-body projectiles with multiple canards which skid to turn, using whichever canards are nearest to vertical to yaw the device.

Figure 4:
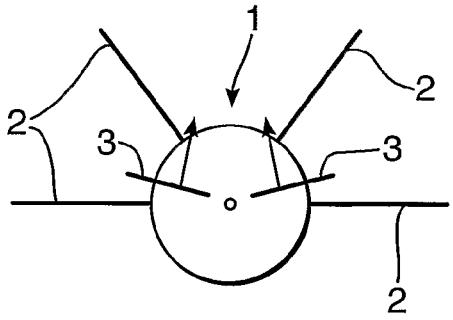
FIG. 4 is a schematic front view of the projectile as configured for its gliding phase.
Figure 5:
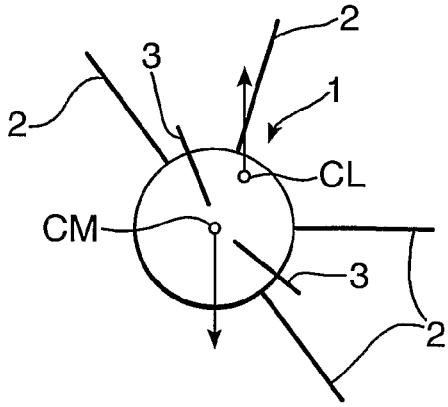
FIG. 5 is a schematic front view of the projectile showing the effect of an off-axis centre of pressure producing a "righting" moment in response to a roll displacement during the gliding phase.

A well known problem with roll-controlling a finned airframe using differential canards is that the wake from the canards may impinge on the tail fins, preventing consistent rolling moments being obtained. Although known projectiles and missiles can overcome the canard roll control problem by allowing all or part of the body to rotate freely or by employing additional control surfaces, the present invention allows the cost of roll-controlled airframes to be greatly reduced in comparison to such prior art, by using canards to control roll indirectly by modifying the direction of the incidence plane. The required rolling moments are then generated by using the dihedral effect of the rotationally asymmetric tail fin configuration. A technical advantage of this solution is that canard/fin aerodynamic interference effects will tend to magnify the canard-generated overturning (pitch or yaw) moments which control the incidence plane even if they nullify the corresponding direct rolling moments. This is because a rearward fin in the downwash of a forward canard on the same side of the body will generate a rolling moment in the opposite direction but an overturning moment in the same direction. To control the incidence plane of the airframe using only two canards 3, it is apparent that they must be able to generate lift forces and therefore moments in any desired radial direction and hence their lifting surfaces cannot be diametrically opposed and should themselves have dihedral, as shown in FIGS. 2 and 4. Alternatively, a greater number of canards could be used to achieve a similar effect, although this would be less desirable due to the additional mechanical complexity.

The differential operation of the canards 3 to bank the projectile 1 may be effected by changing their respective incidence angles, as in the case of conventional canards. Another aspect of the present invention provides an alternative form of canard operation, however, which substantially reduces the complexity and cost of the system.

That is to say, canards are conventionally mounted on shafts which are perpendicular to the longitudinal axis of the airframe and which can turn to vary the angle of incidence of the respective canard to the airflow, and therefore vary the lift forces differentially between the canards to generate the required rolling moments. When the canards must be initially stowed within the body of the device and subsequently deployed into their operative positions in the airstream it is usual to include an extra rotating joint in each shaft so that the respective assembly can sweep forwards or backwards from its stowed to its operative position through a slot provided for the purpose in the body. This requires a two degree-of-freedom mechanism for each canard/shaft assembly, together with a sealing system for the slots to prevent the ingress of rain etc. and reduce drag.

An alternative method in accordance with the invention is to arrange that each canard is both deployed and then controlled to vary its generated lift at a constant angle of incidence by translational or pivotal movement in and out of the body along or about a respective single axis, the lift force generated by each then being dependent on the amount of surface area of the canard which is exposed to the airstream at any particular time. If the cross-section of the canard is also constant along its span with respect to its path of movement it can be extended and retracted through a close-fitting slot without the need of any. additional—or only a simple—sealing means. Further aerodynamic advantages may also be gained if the canards' exposed plan-form shape is generally that of a full "delta" profile, as shown in FIGS. 1, 2 and 6, pivoted at the front, rather than rectangular sections operating in translational mode.

Figure 6:
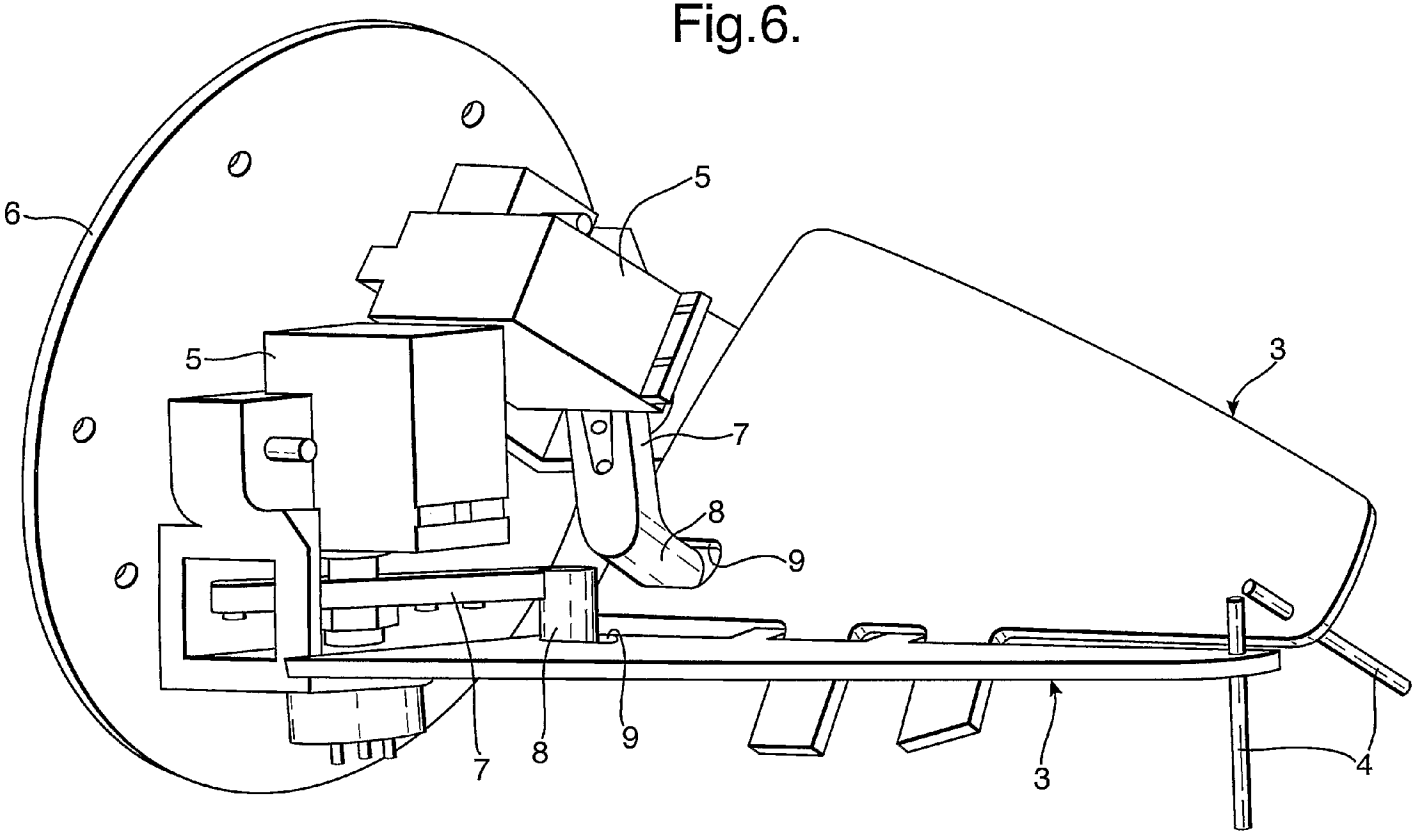
FIG. 6 illustrates schematically one mechanism for extending and retracting the canards of the projectile.

One example of a mechanism of this kind is illustrated schematically in FIG. 6. Each canard 3 is pivoted on a respective axis 4 in the nose of the projectile 1. In the illustrated fully-retracted condition, the outer edge of each canard occupies a respective slot (not shown) in the nose and is profiled to blend substantially seamlessly with the external aerodynamic form of the nose. To deploy and control each canard independently there is a respective electric actuator 5, mounted on a bulkhead 6, which drives a crank arm 7 with a pin 8 engaging in a slot 9 in the respective canard 3. Each actuator is controlled separately in response to the navigational system of the projectile so that turning each arm 8 in the direction and to the extent demanded causes the respective canard to pivot about its axis to extend from or retract into the body of the projectile to such an extent as to leave the amount of surface area exposed to generate the corresponding required amount of lift.

This type of canard control is an independent aspect of the invention and may in principle be applied to the control of canards in all kinds of air or water borne bodies where such devices are typically employed.

Figure 7:
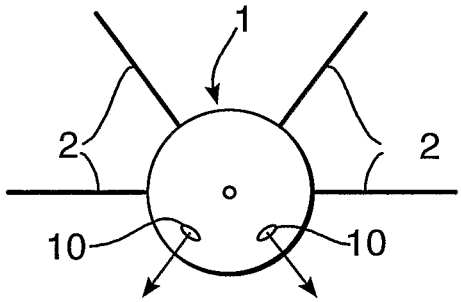
FIG. 7 is a schematic front view of the projectile as configured for its gliding phase with an alternative form of incidence control means.

FIG. 7 illustrates an alternative to the canards 3 for controlling the incidence of the projectile, and initiating rolling moments, during the glide phase. In this case there are a pair of thrusters 10 in the lower part of the nose region which produce individually controllable jets in the directions of the arrows, the reaction forces of which can be used to similar effect as the controllable lift of a pair of dihedral canards.

Although the illustrated projectile has a total of six tail fins 2 other numbers of such fins may be employed in other embodiments, e.g. four, and there may be an odd number, e.g. five, provided that they are initially in a rotationally symmetrical array (equi-spaced around the longitudinal axis of the projectile) and reconfigurable into a rotationally asymmetric array.

The invention claimed is:

1. A body adapted to move in a fluid medium comprising plurality of tail fins and at least a pair of incidence control means at a forward position of the body, and which is deployable, in flight, using one or more actuators, between at least two different configurations, each comprising a different geometry, these comprising (i) a first configuration in which said tail fins are in a generally rotationally symmetrical array around the longitudinal axis of the body and said incidence control means are in an inoperative or less operative condition and (ii) a second configuration in which said tail fins are in a rotationally asymmetric array around the longitudinal axis of the body and said incidence control means are in an operative or more operative condition.

2. A body according to claim 1 wherein one or more of said tail fins are jettisoned or retracted in varying from said first to said second configuration.

3. A body according to claim 1 wherein said incidence control means comprise canards.

4. A body according to claim 3 comprising a single pair of said canards.

5. A body according to claim 4 wherein said canards have positive dihedral with respect to an intended gliding attitude of the body.

6. A body according to claim 1 wherein said incidence control means comprise thrusters.

7. A body according to claim 1, being a projectile or missile.

8. A method of operating a body according to claim 1 to follow a trajectory comprising a ballistic phase followed by a gliding phase wherein the body is in said first configuration during the ballistic phase and varies to said second configuration for the gliding phase.

9. A method according to claim 8 wherein one or more tail fins of said body are jettisoned or retracted in varying from said first to said second configuration.

10. A method according to claim 8 wherein incidence of said body is controlled in the gliding phase by at least a pair of canards.

11. A method according to claim 10 wherein said canards have positive dihedral with respect to the gliding attitude of the body.

12. A method according to claim 8 wherein incidence of said body is controlled in the gliding phase by at least a pair of thrusters.

* * * * *